US010966494B2

(12) United States Patent
McCafferty et al.

(10) Patent No.: US 10,966,494 B2
(45) Date of Patent: Apr. 6, 2021

(54) KITS AND METHODS OF PLAY FOR CREATING DECORATIVE OBJECTS

(71) Applicant: Spin Master Inc., Williamsville, NY (US)

(72) Inventors: Jim McCafferty, San Clemente, CA (US); Steven Delacy, San Clemente, CA (US); Gregory Leong, Irvine, CA (US)

(73) Assignee: SPIN MASTER, INC., Williamsville, NY (US)

( * ) Notice: Subject to any disclaimer, the term of this patent is extended or adjusted under 35 U.S.C. 154(b) by 582 days.

(21) Appl. No.: 15/590,424

(22) Filed: May 9, 2017

(65) Prior Publication Data

US 2018/0325227 A1 Nov. 15, 2018

(51) Int. Cl.

| | |
|---|---|
| ***A44C 27/00*** | (2006.01) |
| ***A44C 15/00*** | (2006.01) |
| ***A63H 33/00*** | (2006.01) |
| ***A44C 11/00*** | (2006.01) |
| *A44C 5/00* | (2006.01) |

(52) U.S. Cl.

CPC ..... *A44C 27/001* (2013.01); *A44C 11/002* (2013.01); *A44C 15/004* (2013.01); *A44C 15/005* (2013.01); *A44C 15/0025* (2013.01); *A44C 27/00* (2013.01); *A63H 33/00* (2013.01); *A44C 5/00* (2013.01)

(58) Field of Classification Search

CPC ..... A44C 27/001; A44C 11/002; A44C 27/00; A44C 15/004; A44C 15/0025; A44C 15/005; A44C 5/00; A63H 33/00

See application file for complete search history.

(56) References Cited

U.S. PATENT DOCUMENTS

| | | | | |
|---|---|---|---|---|
| 1,635,710 A * | 7/1927 | Falor | B26D 3/003 83/176 |
| 3,222,072 A * | 12/1965 | Dreyer | A63F 9/088 273/157 R |
| 3,745,694 A | 7/1973 | Vennola | |
| 5,590,546 A | 1/1997 | Hector | |

(Continued)

FOREIGN PATENT DOCUMENTS

| | | |
|---|---|---|
| CA | 2 327 976 A1 | 11/2002 |
| CN | 101534674 A | 9/2009 |
| WO | 2008015506 A1 | 2/2008 |

OTHER PUBLICATIONS

European Patent Office, Communication, Extended European Search Report, dated Jun. 12, 2018, Application No. EP 17 19 6571, The Maya Group, Inc.; pp. 1-7.

*Primary Examiner* — Rick K Chang
(74) *Attorney, Agent, or Firm* — Millman IP Inc.

(57) ABSTRACT

Kits and methods of play for creating decorative objects are disclosed. In a preferred embodiment, a kit comprises a plurality of rubber sticks, each stick with a continuous internal pattern that extends down the entire length of a longitudinal axis of the stick; a coring device, wherein the coring device includes a core cutter that is designed to cut holes through the plurality of rubber sticks; a cutting device designed to cut segments from the plurality of rubber sticks; and, a plurality of retainers designed to couple a plurality of segments together.

16 Claims, 11 Drawing Sheets

(56) References Cited

U.S. PATENT DOCUMENTS

| | | | | |
|---|---|---|---|---|
| 6,487,949 | B1 * | 12/2002 | Dharia | B26D 3/003<br>83/152 |
| 2007/0221490 | A1 * | 9/2007 | Huang | H01H 13/88<br>200/520 |

* cited by examiner

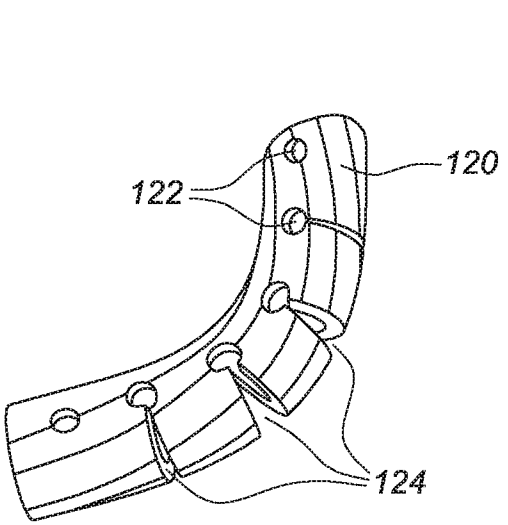
FIG. 11A
FIG. 11B
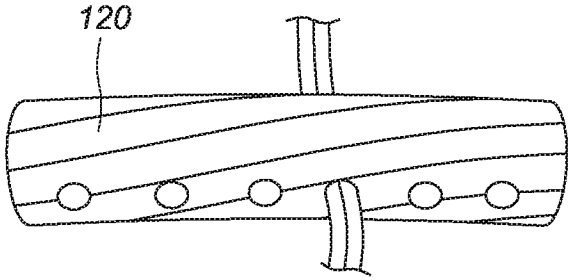
FIG. 11C

KITS AND METHODS OF PLAY FOR CREATING DECORATIVE OBJECTS

FIELD

The present patent document relates generally to toys and, arts and crafts. More specifically, the present patent document relates to kits and methods of play for creating decorative objects.

BACKGROUND

Beaded jewelry has been around for a long time. Kids and adults alike have long found entertainment in placing beads of various colors, shapes and sizes together on some sort of string in order to make necklaces, bracelets and other forms of jewelry. Recently, it has been popular to use beads made from lava stone and other organic stones to create beaded jewelry.

One problem with creating beaded jewelry is that the beads are very small and very easy to lose. Before the beads are restrained together into a necklace or bracelet, it is easy for some of them to be dropped and roll away. The beads' small size can make them difficult to locate and retrieve once dropped.

Another problem with using beads to make jewelry is that beads have a limited amount of variation. Beads come in various sizes and colors but only a limited amount of artistic expression can be achieved by varying size and color, regardless of the possibilities within the variations of size and color.

To this end, it would be beneficial to have apparatus, kits and methods that allowed a wider variation of expression when making decorative objects such as jewelry. It would also be beneficial to use a medium that was easier to keep track of and not so easily lost.

SUMMARY OF THE EMBODIMENTS

One object of the embodiments of the present patent document are to provide methods of creating decorative objects. In preferred embodiments, the method comprises: selecting a first rubber stick with a first continuous internal pattern that extends down the entire longitudinal axis of the first rubber stick; cutting a segment from the first rubber stick; coring a hole through the segment; and inserting a retainer into the hole such that the segment is coupled to the retainer.

In various different embodiments, the decorative object can be one of many different final products including a necklace, a bracelet, wall art, nail art, animal figures, key chains, decorations for electronics cords or many other products.

As may be understood, numerous segments cut from many different flexible rubber sticks may be combined together. Accordingly, the embodiments may repeat the selecting, cutting and coring process over and over and may further comprise selecting a second rubber stick with a second continuous internal pattern that extends down the entire longitudinal axis of the second rubber stick; cutting a second segment from the second rubber stick; coring a second hole through the segment; and inserting the retainer into the second hole such that the second segment is coupled to the retainer.

In the different embodiments, the retainer used to couple the plurality of segments together may be embodied by string, fishing line, double-sided posts, cord of various materials, or any other type of retainer that preferably couples either loosely or rigidly to the hole cored in the segment.

In some embodiments, the cutting step comprises: placing the first rubber stick into a tubular chamber such that a portion of the first rubber stick extends past a cutting plane of the tubular chamber; forcing a cutting edge down the cutting plane to slice the segment away from the first rubber stick. In some embodiments, the cutting edge is coupled to a plunger that extends vertically above the tubular chamber and perpendicular to the longitudinal axis of the tubular chamber.

In some embodiments, the coring step comprises: placing the segment in a central chamber of a coring block wherein the coring block has two through holes passing through the center of the central chamber, one through hole passes through the transverse axis and another through hole passes through perpendicular to the transverse axis; and placing the coring block within a coring device and pressing a cutter through the segment to form the hole.

In embodiments that include a coring device, the coring device may restrict the coring block to be inserted in two different orientations wherein each of the two orientations aligns the cutter with one of the two through holes.

In some embodiments, apparatus may be used to help thread the retainer through the core holes in the segments cut from the flexible sticks. In some embodiments, the first segment and second segment are placed on a tube and the retainer is threaded through the tube and then the first segment and second segment are pulled off of the tube onto just the retainer.

In another aspect of the present invention, a kit for creating a decorative object is provided. In preferred embodiments, the kit comprises: a plurality of rubber sticks, each stick with a continuous internal pattern that extends down the entire longitudinal axis of the stick; a coring device, wherein the coring device includes a core cutter that is designed to cut holes through the plurality of rubber sticks; a cutting device designed to cut segments from the plurality of rubber sticks; and, a plurality of retainers designed to couple a plurality of segments together.

As discussed above, the retainer may take a variety of forms. Accordingly, the kit may include a plurality of retainers comprised of string and/or double-sided posts designed to couple exactly two segments to each other.

In some embodiments of the kit, the flexible sticks, which are preferably rubber, have different diameters and different continuous internal patterns.

In embodiments of the kit that include a cutting device, the cutting device may include a tubular chamber to receive a rubber stick and secure the rubber stick such that a portion of the rubber stick along a longitudinal axis of the rubber stick extends past a cutting plane of the tubular chamber and wherein the cutting device further includes a cutting edge designed to traverse along the cutting plane when a handle is depressed.

The kit of claim 11 further comprising a coring block with a central chamber wherein the coring block has two through holes passing through the center of the central chamber, one through hole passes through the transverse axis and another through hole passes through perpendicular to the transverse axis. In embodiments with a coring block, the coring device restricts the coring block to be inserted in two different orientations wherein each of the two orientations aligns the cutter with one of the two through holes.

Some kits also include a threading device comprised by a tube that is coupled to a base on one end such that the tube may rotate about the one end.

BRIEF DESCRIPTION OF THE DRAWINGS

FIG. 11A illustrates a precut and pre-cored flexible piece for use in creating decorative objects.

FIG. 11B illustrates the precut and pre-cored flexible piece of FIG. 11A being bent to show the plurality of slits.

FIG. 11C illustrates the precut and pre-cored flexible piece of FIGS. 11A and 11B with a cord threaded through one of the cored holes.

DETAILED DESCRIPTION OF THE PREFERRED EMBODIMENTS

Kits and methods of play for creating decorative objects are provided. A key feature of the embodiments disclosed herein is the use of flexible sticks for the source of individual elements used to create the decorative objects. These flexible sticks have a continuous internal pattern that extends down the entire longitudinal axis of the flexible stick. The flexible sticks are key to the embodiments herein because they provide a medium for which decorative elements may be created. Thin segments may be cut from the flexible sticks exposing the internal pattern on both sides of the segment. The segments may then be cored with a hole and combined together on a retainer such as string to create decorative objects.

Figure 1:
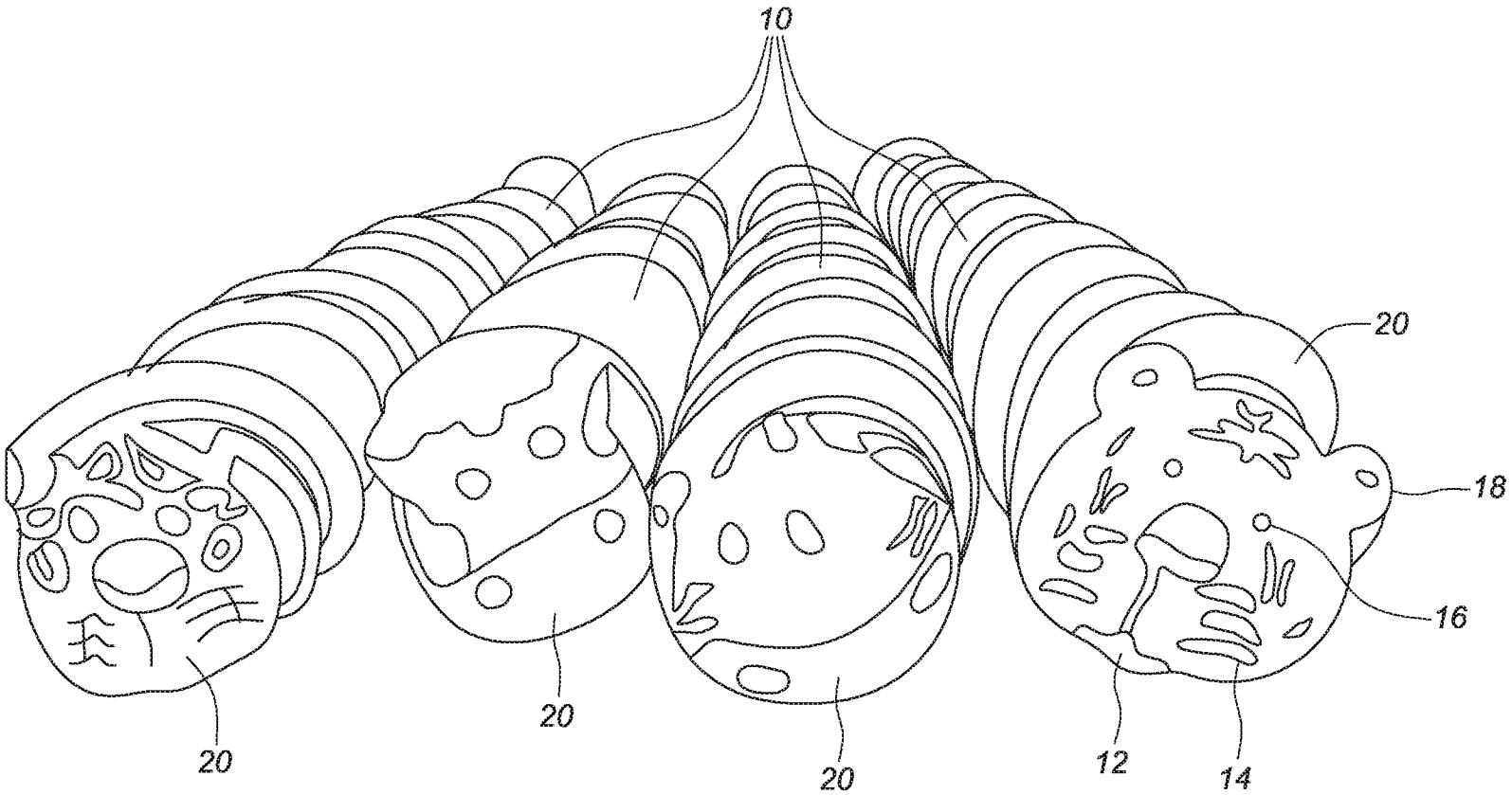
FIG. 1 illustrates four flexible sticks each with an internal pattern that runs along the entire length of the longitudinal axis.

FIG. 1 illustrates four flexible sticks 10 each with an internal pattern 20. In preferred embodiments, the sticks 10 are made of a flexible material and preferably a soft flexible material. Rubber is the ideal material for making flexible sticks 10 but other materials may be used.

As may be seen in FIG. 1, each flexible stick 10 has an internal pattern 20 infused on the cross-section of the flexible stick 10. The pattern may be any pattern and may be abstract or realistic. In the embodiments shown in FIG. 1, each flexible stick 10 has a different internal pattern 20 of an animal face. In preferred embodiments, the pattern extends down the entire longitudinal axis of the flexible stick 10. In some embodiments, the pattern may alter as it traverses the longitudinal axis of the stick. For example, the pattern may transition from one pattern at one end of the flexible stick 10 to a second pattern at the opposite end of the flexible stick 10.

In a preferred embodiment, the pattern 20 is a type of recognizable graphic. As may be seen in FIG. 1, the patterns used are the face of a lion, giraffe, zebra and tiger. The faces in FIG. 1 are caricatures of animals but more realistic graphics may be used. In addition, the patterns or images that run along the length of the longitudinal axis of the flexible sticks may be anything including, animal faces, animal paws, animal bodies, fruits, numbers, letters, abstract designs, words, full animals or figures, faces, foods, sports items, sports balls, logos, emojis, other designs, or any combinations thereof.

Figure 2:
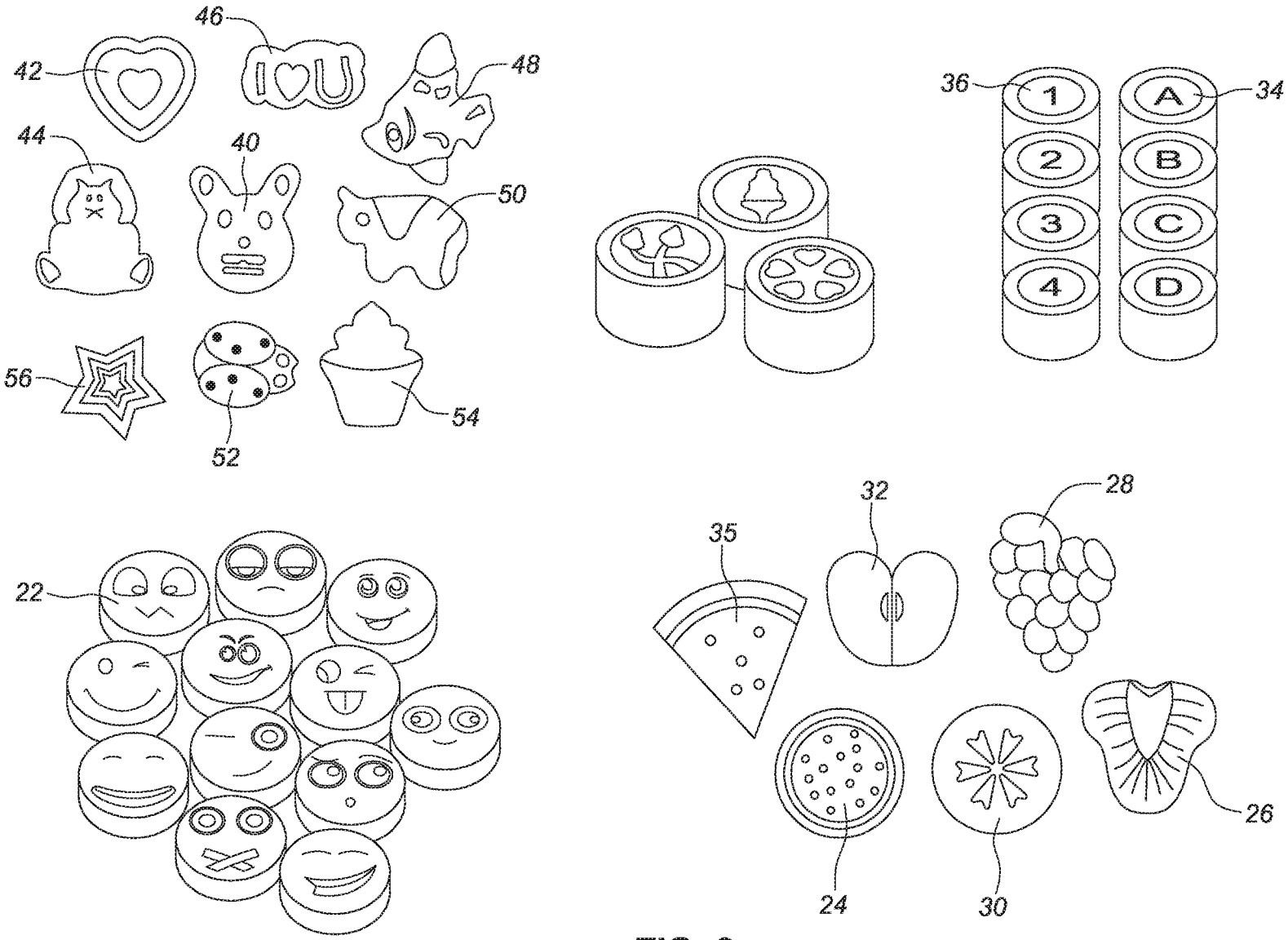
FIG. 2 illustrates numerous different slices or segments with a variety of internal patterns displayed on their cross-sectional faces.

In preferred embodiments, a thin slice or segment of the flexible stick may be separated from the rest of the flexible stick to form an element for use in making a decorative object. FIG. 2 illustrates numerous different slices or segments 22-56 with a variety of internal patterns displayed on their cross-sectional faces. As may be seen in FIG. 2, the slices or segments may be of various different thicknesses and may be made from flexible sticks with a variety of different patterns. FIG. 2 illustrates segments that include emoji's 22, whole fruit watermelon 24, strawberry slices 26, grape bunches 28, apple slices 32, watermelon slices 35, numbers 34, letters 36, bear faces 40, hearts 42, full lions 44, phrases 46, fish 48, donkeys 50, lady bugs 52, cupcakes 54 and stars 56. As may be appreciated, lots of other graphics, shapes, patterns or designs may be used as the pattern in the flexible sticks.

Figure 3B:
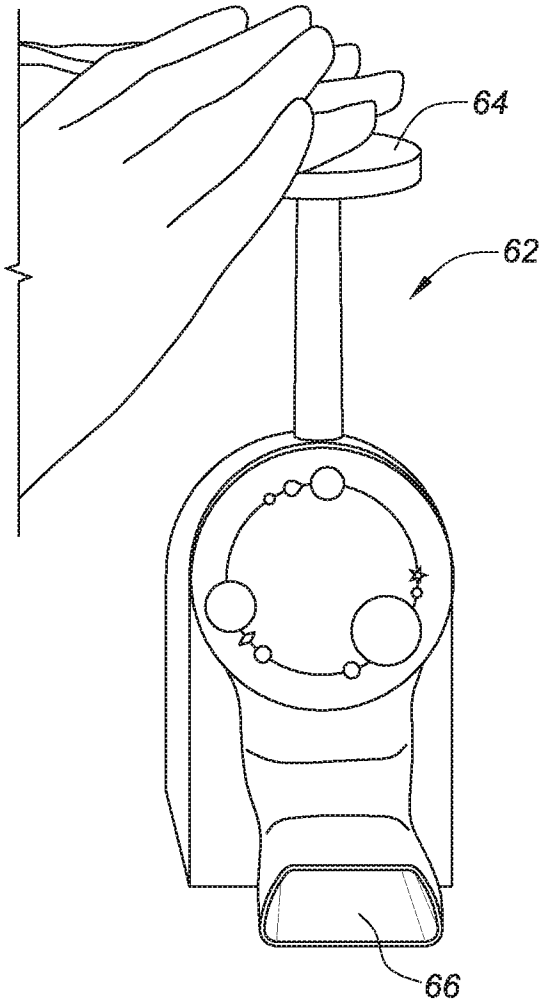
FIG. 3B illustrates a cutting device designed to cut segments from a plurality of rubber sticks.
Figure 3A:
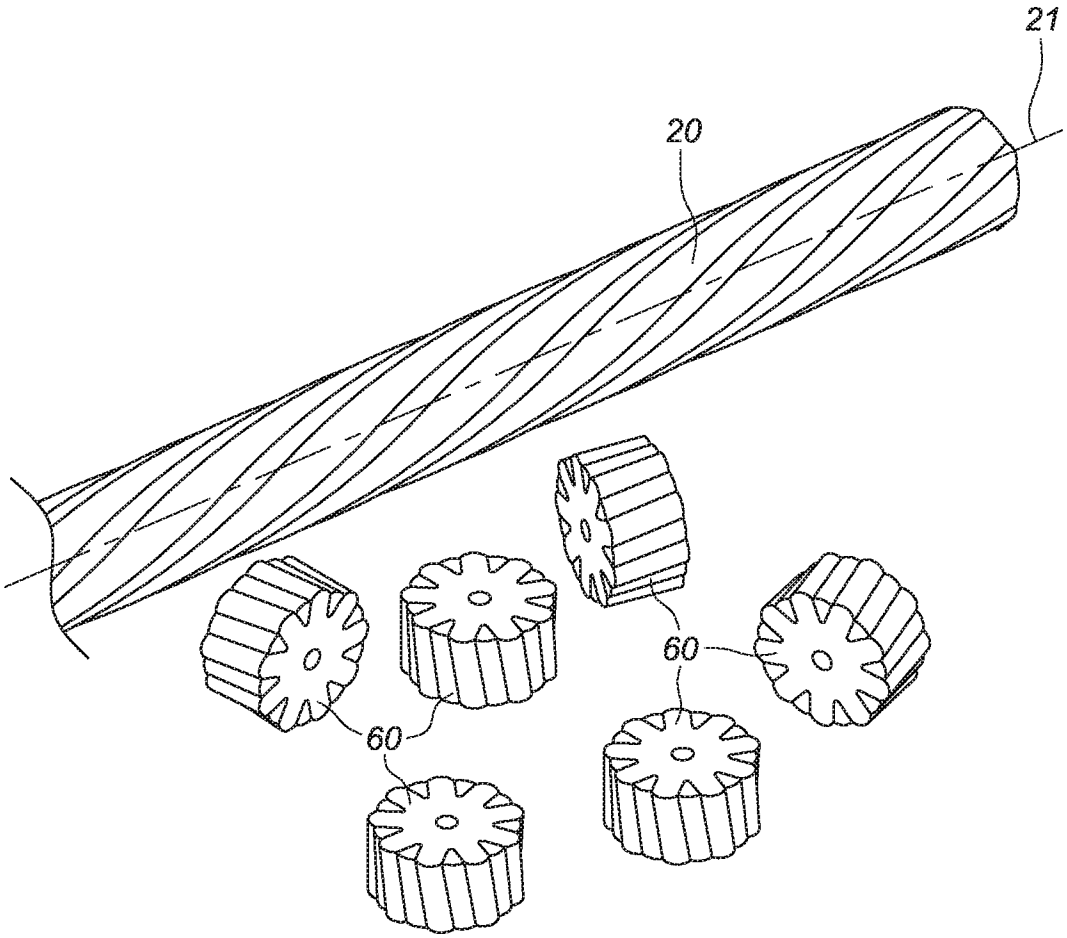
FIG. 3A illustrates a plurality of segments separated from a flexible stick.

FIG. 3A illustrates a plurality of segments 60 separated from a flexible stick 20. As may be seen, the flexible stick 20 in FIG. 3A has a star pattern that runs continuously along its transverse axis 21. Segments 60 may be any thickness and are cut by slicing perpendicular to the transverse axis along a cross-sectional plane. This creates segments 60, which expose the internal pattern of the flexible stick 20 on both outside faces.

FIG. 3B illustrates a cutting device 62 designed to cut segments from a plurality of rubber sticks. The cutting device 62 comprises a tubular chamber (not shown in FIG. 3B) such that a portion of the first rubber stick extends past a cutting plane of the tubular chamber. A cutting edge is coupled to the vertical plunger 64 and when the vertical plunger 64 is depressed, a cutting edge is forced down the cutting plane to slice the segment away from the first rubber stick. The segment exits the cutting device via the ramp 66. In preferred embodiments, the tubular chamber allows the end of the rubber stick to be cut while completely encased by the cutting device 64 to make sure injury is impossible. To this end, the cutting plane and cutting edge are all enclosed by, and internal to, the cutting device 64.

Figure 4:
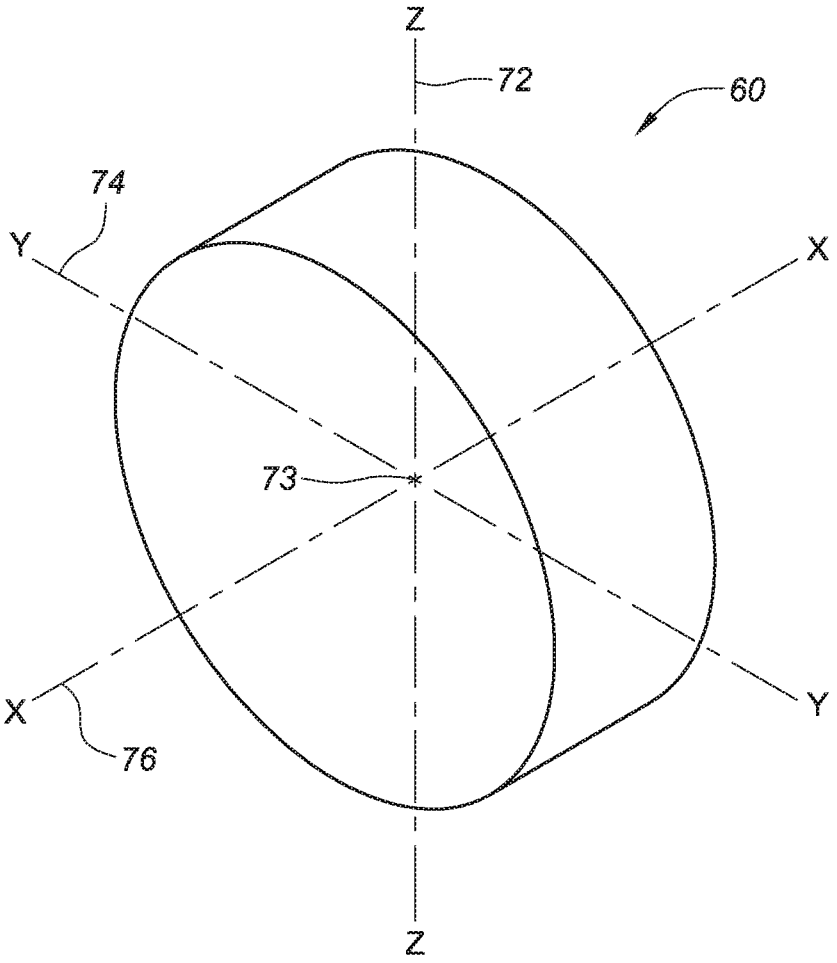
FIG. 4 illustrates three perpendicular axes of a segment.

Once segments 60 are cut, they can be cored. Coring involves forming a hole through an axis of the segment 60. FIG. 4 illustrates a segment 60 with three axes 72, 74 and 76. The axes are labelled X, Y, and Z as is customary. All three axes pass through the central point 73 of the segment 60. When coring a segment 60, a hole is preferably formed along one of the axes 72, 74 or 76. As may be appreciated, the axes 72 and 74 that correspond to Y and Z may be rotated about the X axis such that the coring hole may pass through any portion of the segment 60. In preferred embodiments, the hole passes all the way through the segment 60 and passes through the central point 73.

Figure 5B:
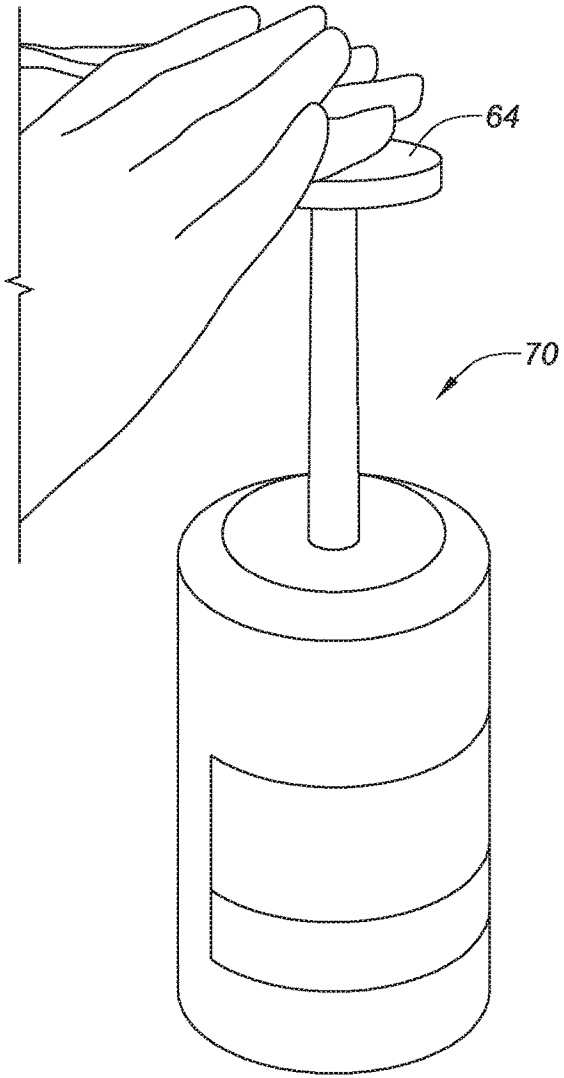
FIG. 5B illustrates one embodiment of a coring device.
Figure 5A:
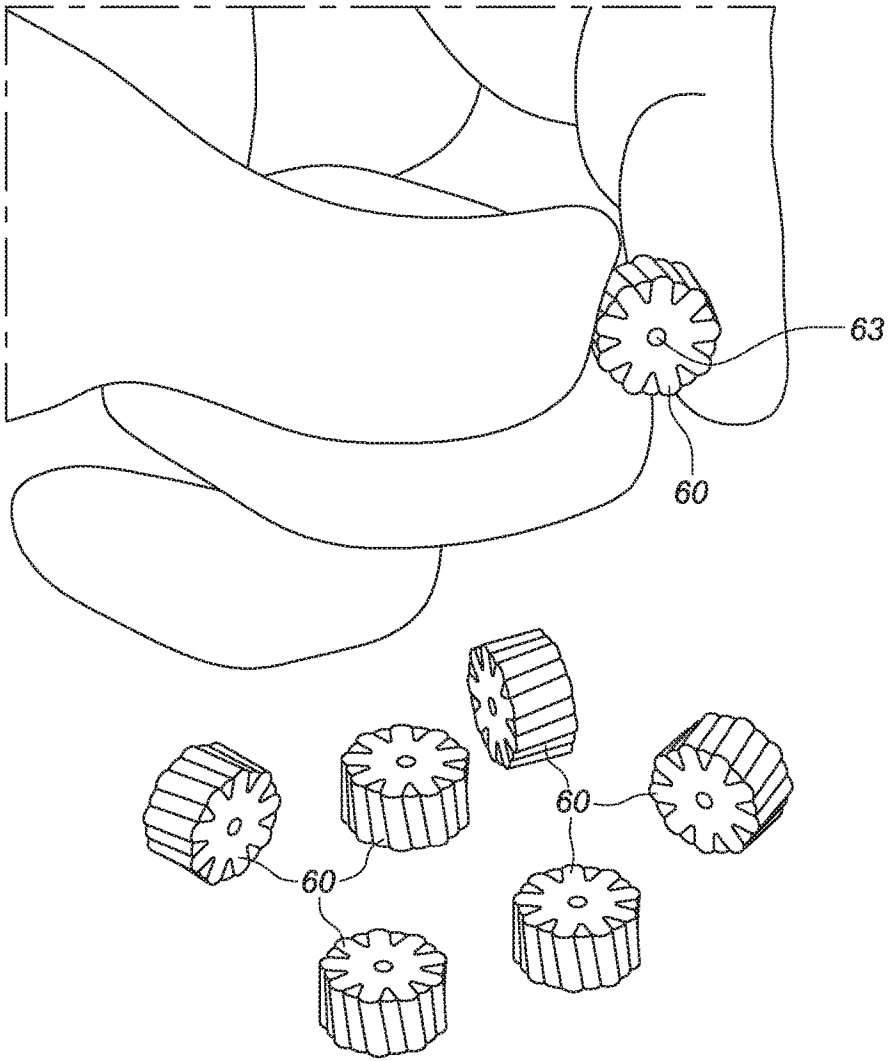
FIG. 5A illustrates a plurality of segments sliced from a flexible stick.

FIG. 5A illustrates a plurality of segments 60 sliced from a flexible stick. The segment 60 being held by the hand has been cored forming the hole 63 through the segment 60 along the longitudinal axis.

FIG. 5B illustrates one embodiment of a coring device 70. Coring device 70 includes a core cutter that is designed to cut holes through a segment 60. The core cutter may be a metal tube or metal pin. Similar to the cutting device 62 shown in FIG. 3B, the coring device 70 has a plunger 64. The plunger 64 is coupled to the core cutter such that when the plunger 64 is depressed, the core cutter is pushed down through the segment 60 and forms hole 63.

Figure 6B:
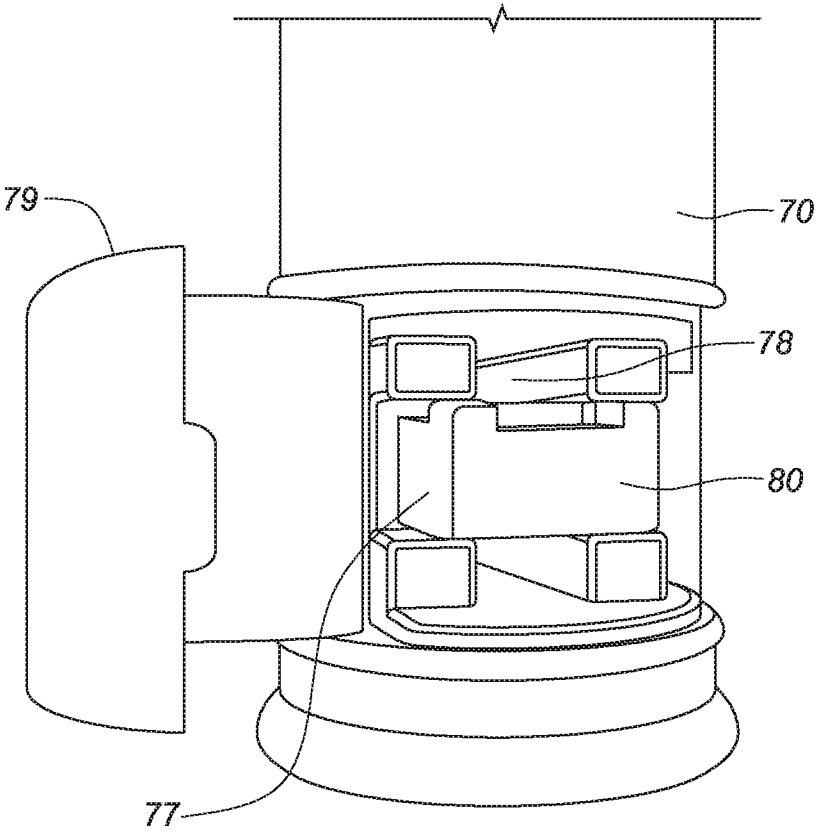
FIG. 6B illustrates the coring block of FIG. 6A inserted into a coring device like the one from FIG. 5B.
Figure 6A:
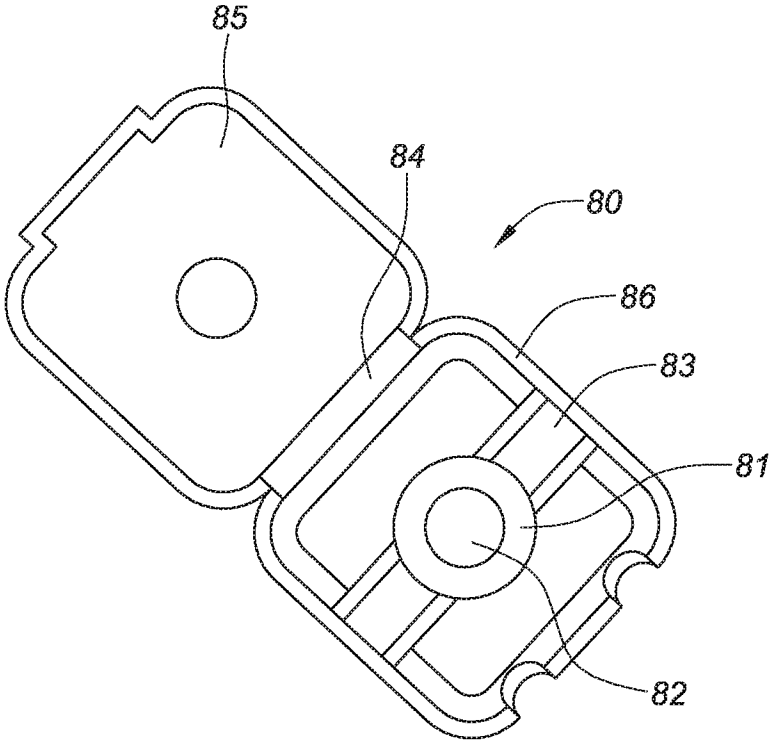
FIG. 6A illustrates one embodiment of a coring block for use with the coring device of FIG. 5B.

FIG. 6A illustrates one embodiment of a coring block 80 for use with the coring device 70 of FIG. 5B. In some embodiments, a coring block 80 may be used in order to safely hold the segment in the correct orientation when performing the coring step. The coring block 80 includes a two-piece construction with a body 86 and a lid 85. The body and the lid couple together to form the coring block 80. In the embodiment shown in FIG. 6, the body 86 and the lid 85 are coupled with hinge 84. Hinge 84 allows the lid 85 to be coupled to the body 86 but easily rotated away from the body to allow access to the interior of the coring block 80.

Coring block 80 includes an inner chamber 81. Inner chamber 81 is designed to hold a segment 60. In the embodiment of FIG. 6A inner chamber 81 is circular to allow the retention of a segment 60. However, in other embodiments, FIG. 6A may be any shape. In operation, a segment 60 is placed in the inner chamber 81 and the lid 85 is closed against the body 86. Coring block 80 further includes through holes 82 and 83 that both pass through the center of the central chamber of coring block 80. The through holes pass through the coring block 80 on axes that are perpendicular to each other. As may be seen in FIG. 6A, if segment 60 is placed with its flat side or cross-sectional side down against the flat wall of chamber 81, through hole 83 is aligned with the transverse axis of the segment 60 and through hole 82 is aligned with the longitudinal axis of the segment 60. Referring back to FIG. 4, the X axis 76 would be considered the longitudinal axis and either of the Y axis 74 or Z axis 72 would be considered a transverse axis.

In operation, a segment 60 is placed inside of the central chamber 81 of coring block 80. The lid 85 is closed against the body 86 and the assembly is placed in coring device 70 from FIG. 5B. The plunger is then depressed and a core cutter is forced through the segment to form a hole. The axis that the hole is formed along depends on the orientation of the coring block within the coring device.

FIG. 6B illustrates the coring block 80 of FIG. 6A inserted into a coring device 70. The coring device 70 includes a chamber that has two perpendicular slots 77 and 78 to receive the coring block 80. If the coring block 80 is placed in the first slot in the first orientation, the through hole 83 that aligns with the transverse axis of the segment is aligned with the core cutter and thus, when the plunger is depressed a transverse hole is cut in the segment. FIG. 6B illustrates the coring block 80 instead placed in the second slot in the second orientation perpendicular to the first. In this orientation, the hole 82 that runs along the longitudinal axis is aligned with the core cutter and when the plunger 64 is depressed a hole is formed along the longitudinal axis of the segment 60. In some embodiments, coring device 70 may have a door 79 to enclose the chamber. The door 79 may provide added safety. In some embodiments, a mechanical lock prevents the plunger 64 from being depressed when door 79 is open.

Figure 7:
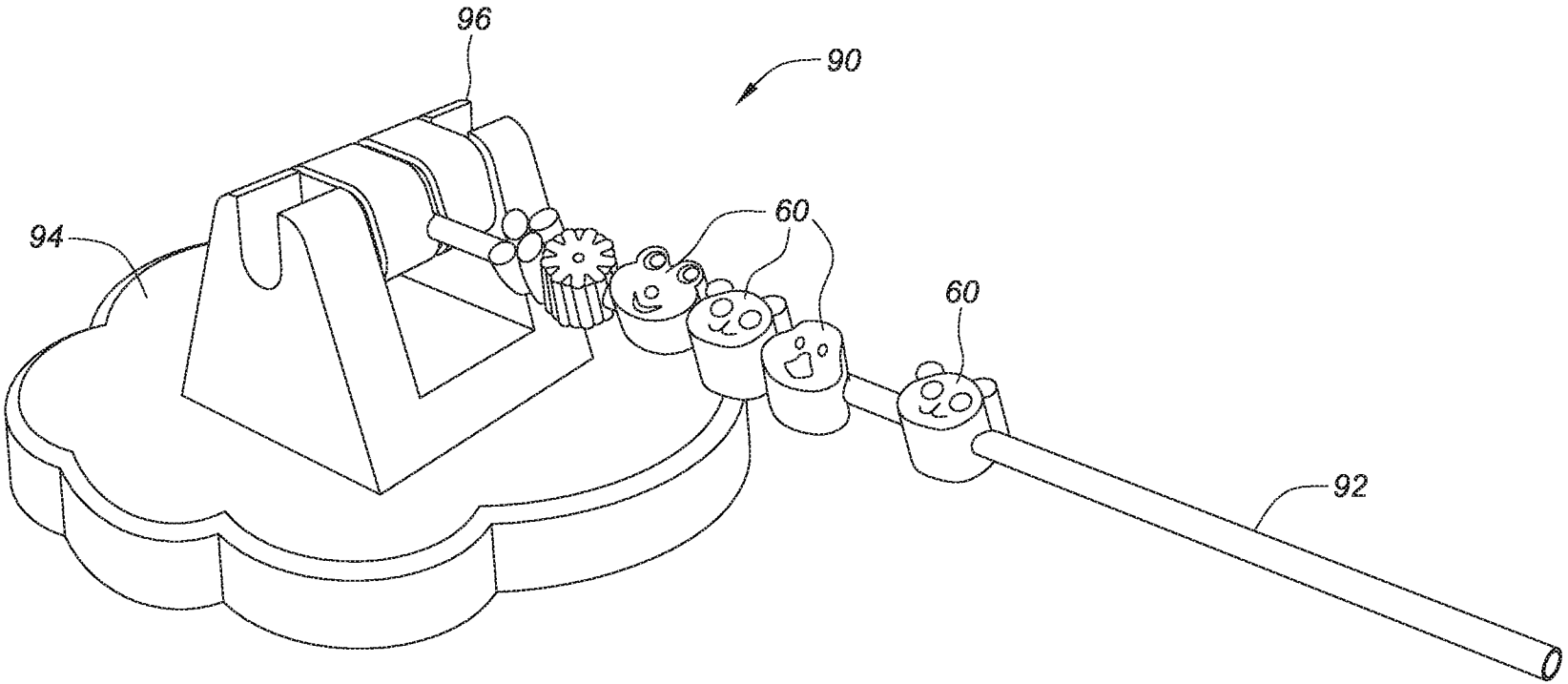
FIG. 7 illustrates one embodiment of a threading device.

FIG. 7 illustrates one embodiment of a threading device 90. The threading device 90 comprises a base 94 and a tube 92. The tube 92 is coupled to the base 94 on one end such that the tube may rotate about the one end. In the embodiment shown in FIG. 7, the tube 92 is coupled to the base 94 via pivot 96. Pivot 95 allows tube 92 to be rotated about one end.

In operation, a plurality of segments 60 may be placed on the tube 92 by pushing the tube 92 through the holes cored in the segments 60. In this way, a designer can see how their segments look by combining them on the tube 92. Once the desirable segments are arranged on the tube 92, a retainer such as a string, wire or other retainer can be threaded through the tube. The segments may then be all pulled off the tube and onto the retainer. Using a tube makes designing various decorative objects easier.

Returning to FIG. 1, it may be seen that although the rubber sticks 10 are generally cylindrical, there is no requirement that they are cylindrical. In fact, the outside dimensions of the flexible sticks 10 may be any shape. As may be seen in FIG. 1, the outside dimensions of the flexible sticks 10 account for the features of the pattern such as animal ears and other features. Generally, the outside dimensions of the flexible sticks 10 will be driven by the pattern that runs along the longitudinal axis and the cross-section required to form such a pattern. As one can appreciate, if a star is used as the internal pattern, the outside dimensions of the flexible stick 10 may be in the shape of a star.

The process of selecting a flexible stick 10, cutting one or more segments 60 from the flexible sticks, and coring the segments has been explained above. In some embodiments, a flexible stick may first be cored and then the segment cut from the flexible stick. In such embodiments, the segment is cut to include the hole created by the coring. Once one or more segments 60 are created, the segments may be combined by retaining them together with some sort of retainer. For example, if a necklace or bracelet is desired, the segments may be combined on a string or wire by threading the string or wire through the holes made during coring. Because the coring hole may pass through the segment along various different axes, the orientation of the segments on the retainer may be varied.

Figure 8B:
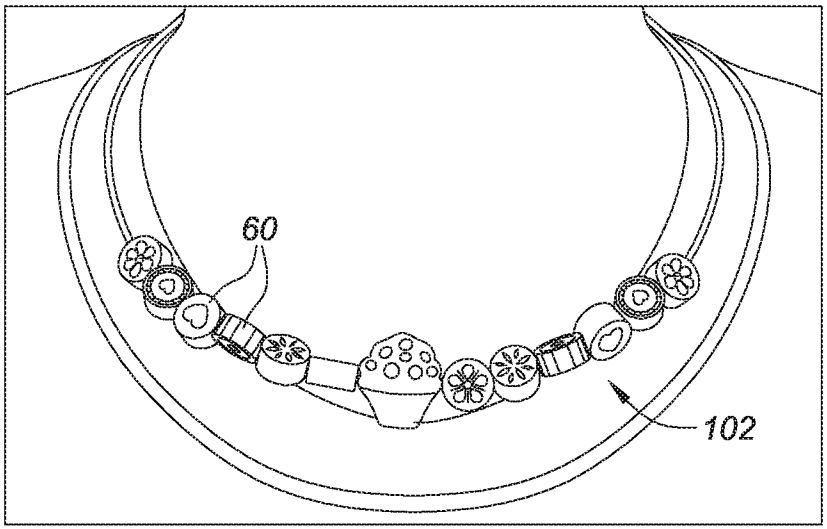
FIG. 8B illustrates a necklace made in a similar manner to the bracelet of FIG. 8A.
Figure 8A:
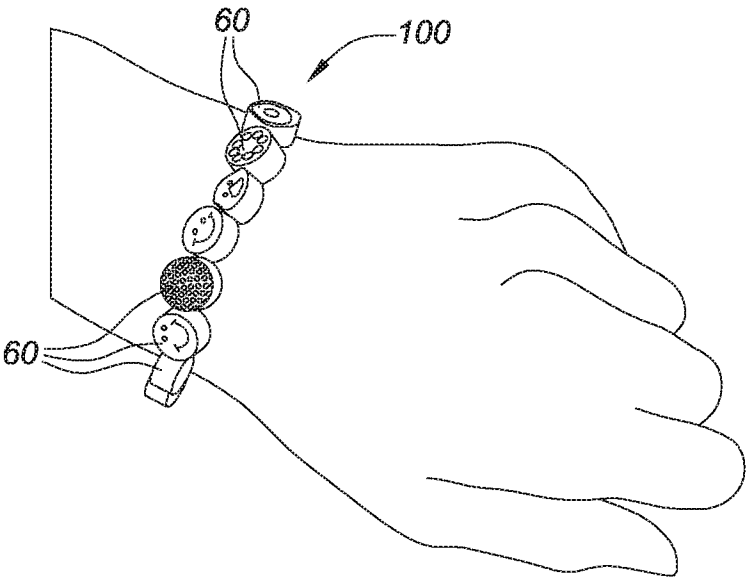
FIG. 8A illustrates a bracelet made by placing a plurality of segments cut from the flexible sticks disclosed herein on a string and then attaching the two ends of the string.

FIG. 8A illustrates a bracelet 100 made by placing a plurality of segments 60 cut from the flexible sticks 10 on a string and then attaching the two ends of the string. FIG. 8B illustrates a necklace 102 made in a similar manner to the bracelet 100 of FIG. 8A. As may be seen, various different segments from various different flexible sticks can be combined together to make decorative objects. The segments may all have different patterns or colors or they may be the same or similar. The segments 60 may be of various different shapes and sizes and may be cored along different axes.

When retaining segments for necklaces, bracelets or other types of decorative objects, string may be used. However, cord made of plastic rubber, fishing line, or other types of retainers may be used.

Figure 9:
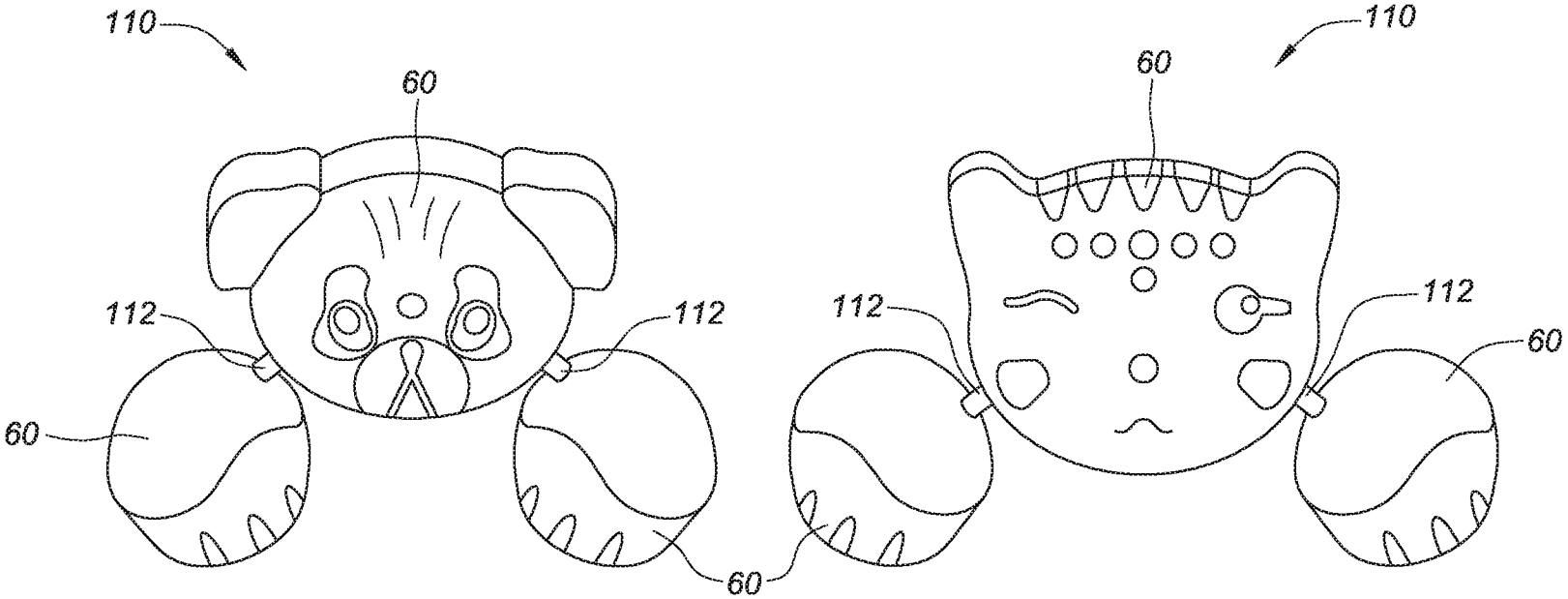
FIG. 9 illustrates two decorative objects in the form of animal figures that were created using a plurality of segments and double-sided posts.

In some embodiments, the retainer may be a double-sided post designed to couple exactly two segments to each other. FIG. 9 illustrates two decorative objects in the form of animal figures that were created using a plurality of segments 60 and double-sided posts 112. In the embodiments shown, segments were coupled by placing a single segment on each side of a double-sided post 112. The central segment in the shape of an animal head used a single doubled sided post on each side at about 120 degrees apart to form paws. In the embodiments shown, the core holes are not required to pass all the way through the segment but may simply go into the segment far enough to allow the insertion of the double-sided post 112. As may be appreciated, a plurality of double-sided sticks 112 may be used together with a plurality of segments 60 to create various different kinds of characters or other decorative objects. In some embodiments, more than three segments may be coupled together using double-sided posts 112.

Figure 10:
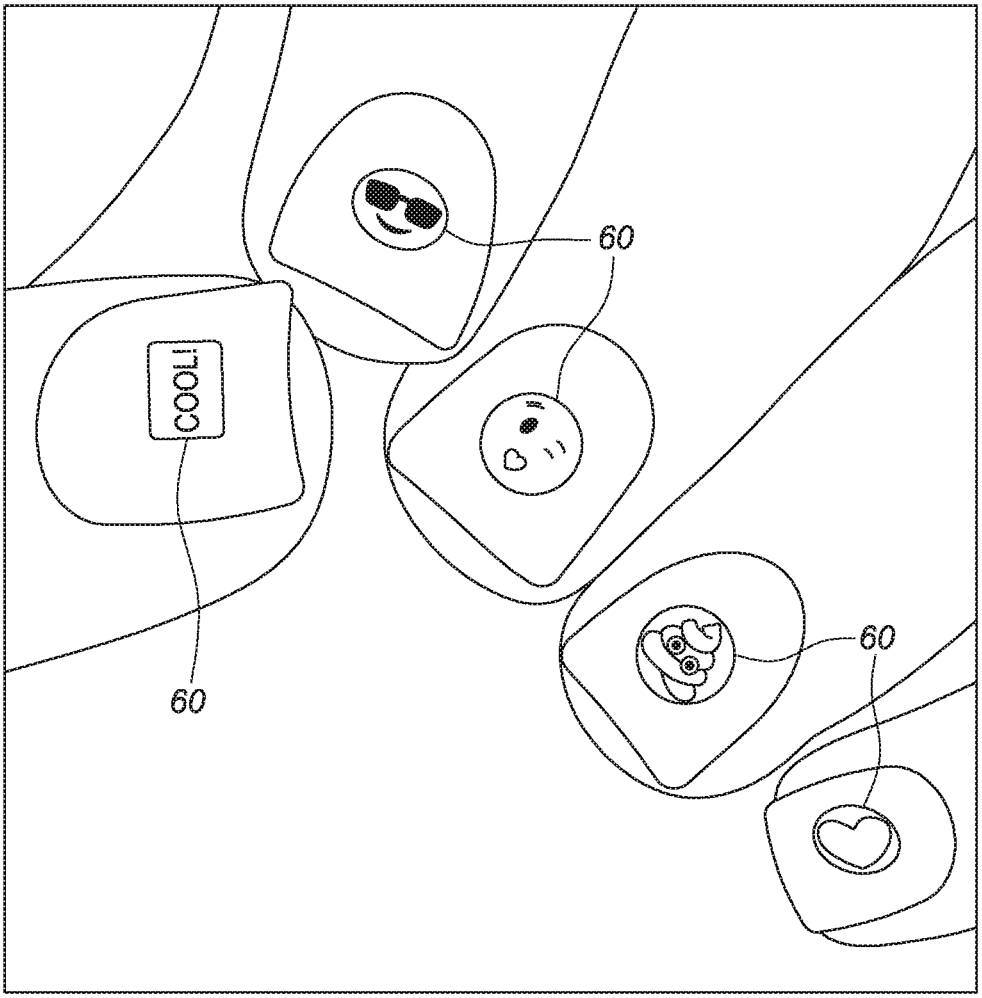
FIG. 10 illustrates the use of segments as a form of nail art with a single segment on each nail.

In yet another embodiment, the segments 60 may be applied to nails as a form of nail art. FIG. 10 illustrates the use of segments 60 as a form of nail art with a single segment on each nail. In such embodiments, segments 60 may be sliced thinner so as not to protrude too far above the nail. The segments 50 may then be applied to the nail with an adhesive. Multiple segments 60 may be used on a nail or a single segment may be used.

In addition to necklaces, jewelry and nail art, segments of the flexible stick may be coupled together to create, wall art, wall hangings, trend boards, displays, key chains, sun catchers, decorations for shoe laces, hair clips and accessories, and decorations for electronic cords such as headphone cords, just to name a few.

In preferred embodiments, the elements needed to create decorative objects using the methods disclosed herein may be provided in a kit. In preferred embodiments, the kit may comprise a plurality of flexible sticks, more preferably a plurality of rubber sticks, each stick with a continuous internal pattern that extends down the entire longitudinal axis of the stick. The kit should also include a coring device, wherein the coring device includes a core cutter that is designed to cut holes through the plurality of rubber sticks. The kit also needs a cutting device designed to cut segments from the plurality of rubber sticks. Finally, the kit should include a plurality of retainers designed to couple a plurality of segments together.

As discussed above, the retainers in the kit may be string, double-sided posts or a variety of other types of retainers. The rubber sticks in the kit may be of different diameters and may have different continuous internal patterns.

In addition, the kit may include a number of different precut flexible pieces designed to make the creation of beads and parts easier. FIG. 11A illustrates a precut and pre-cored flexible piece 120 for use in creating decorative objects. As may be seen in FIG. 11A, the precut flexible piece 120 includes a plurality of transverse core holes 122. In addition to the precut core holes 122, FIG. 11B illustrates that the precut flexible piece 120 may further include a plurality of slits 124 that are also transverse and extend halfway across the diameter. As may be seen in FIG. 11C, the slits 124 and core holes 122 allow a plurality of cords to be easily captured and separated.

In yet another embodiment, the segments may be used in combination with line art. For example, the segments could be created and stuck to a piece of line art. The play pattern could then allow the user to color around the segments. Accordingly, the segments could be used in combination with traditional line art like coloring books and the like.

Although the inventions have been described with reference to preferred embodiments and specific examples, it will readily be appreciated by those skilled in the art that many modifications and adaptations of the methods and devices described herein are possible without departure from the spirit and scope of the inventions as claimed hereinafter. Thus, it is to be clearly understood that this description is made only by way of example and not as a limitation on the scope of the claims below.

What is claimed is:

1. A kit for creating a decorative object comprising:

a plurality of rubber sticks, each stick with a continuous internal pattern that extends down an entire length of a longitudinal axis of the rubber stick;

a cutting device to cut segments from the plurality of rubber sticks, includes a tubular chamber to receive a rubber stick and secure the rubber stick such that a portion of the rubber stick along a longitudinal axis of the rubber stick extends past a cutting plane of the cutting device, the cutting plane being generally perpendicular to the longitudinal axis of the rubber stick, wherein the cutting device further includes a cutting edge that is movable along the cutting plane cross-sectionally through the rubber stick, by depression of a handle;

a coring device, wherein the coring device includes a core cutter that is designed to cut holes through the segments; and a plurality of retainers shaped to couple a plurality of segments together.

2. The kit of claim 1, wherein the plurality of retainers includes string.

3. The kit of claim 1, wherein the plurality of retainers includes a plurality of double-sided posts designed to couple exactly two segments to each other.

4. The kit of claim 1, wherein the plurality of rubber sticks includes rubber sticks of different diameters and rubber sticks with different continuous internal patterns.

5. The kit of claim 1 further comprising a coring block with a central chamber wherein the coring block has two through holes passing through the center of the central chamber, one through hole passes through the transverse axis and another through hole passes through perpendicular to the transverse axis.

6. The kit of claim 5 wherein the coring device allows the coring block to be inserted in two different orientations wherein each of the two orientations aligns the core cutter with one of the two through holes.

7. The kit of claim 1, further comprising a threading device includes a tube that is coupled to a base on one end such that the tube may rotate about the one end.

8. The kit of claim 1, wherein the cutting edge is coupled to a plunger that extends vertically above the tubular chamber and perpendicular to the longitudinal axis of the tubular chamber.

9. A kit for creating a decorative object comprising:

a plurality of rubber sticks, each stick with a continuous internal pattern that extends down an entire length of a longitudinal axis of the rubber stick;

a cutting device designed to cut segments from the plurality of rubber sticks; and, a plurality of retainers designed to couple a plurality of segments together;

a coring device, wherein the coring device includes a core cutter that is positioned to cut holes through the segments; and a coring block with a central chamber wherein the coring block has two through holes passing through the center of the central chamber, one through hole passes through the transverse axis and another through hole passes through perpendicular to the transverse axis.

10. The kit of claim 9, wherein the plurality of retainers includes string.

11. The kit of claim 9, wherein the plurality of retainers includes a plurality of double-sided posts designed to couple exactly two segments to each other.

12. The kit of claim 9, wherein the plurality of rubber sticks includes rubber sticks of different diameters and rubber sticks with different continuous internal patterns.

13. The kit of claim 9, wherein the cutting device includes a tubular chamber to receive a rubber stick and secure the rubber stick such that a portion of the rubber stick along a longitudinal axis of the rubber stick extends past a cutting plane of the tubular chamber and wherein the cutting device further includes a cutting edge designed to traverse along the cutting plane when a handle is depressed.

14. The kit of claim 13, wherein the cutting edge is coupled to a plunger that extends vertically above the tubular chamber and perpendicular to the longitudinal axis of the tubular chamber.

15. The kit of claim 9 wherein the coring device allows the coring block to be inserted in two different orientations wherein each of the two orientations aligns the core cutter with one of the two through holes.

16. The kit of claim 9, further comprising a threading device that includes a tube that is coupled to a base on one end such that the tube may rotate about the one end.

* * * * *